United States Patent [19]

Broughton et al.

[11] Patent Number: 5,065,723

[45] **Date of Patent: * Nov. 19, 1991**

[54] MARINE PROPULSION DEVICE WITH SPARK TIMING AND FUEL SUPPLY CONTROL MECHANISM

[75] Inventors: George L. Broughton, Waukegan; Gregory B. Binversie, Grayslake, both of Ill.; Henry C. Billingsley, Kenosha, Wis.

[73] Assignee: Outboard Marine Corporation, Waukegan, Ill.

[ * ] Notice: The portion of the term of this patent subsequent to May 31, 2005 has been disclaimed.

[21] Appl. No.: 66,142

[22] Filed: Jun. 24, 1987

[51] Int. Cl.[5] ..... F02P 5/02

[52] U.S. Cl. ..... 123/413; 440/87

[58] Field of Search ..... 123/413, 395, 400, 403; 440/87

[56] References Cited

U.S. PATENT DOCUMENTS

| | | | |
|---|---|---|---|
| 1,203,184 | 10/1916 | Clark | 74/582 |
| 1,886,566 | 11/1932 | Mallory | 123/413 |
| 1,895,328 | 1/1933 | Howe | 123/413 |
| 2,069,931 | 2/1937 | Trott | 123/413 |
| 2,635,595 | 4/1953 | Raleigh | 123/403 |
| 2,890,689 | 6/1959 | Alexander | 123/334 |
| 2,906,251 | 9/1959 | Soder, Jr. | 123/413 |
| 2,982,275 | 5/1961 | Doman et al. | 123/413 |
| 3,195,529 | 7/1965 | Walker | 123/407 |
| 3,734,069 | 5/1973 | Akiyama et al. | 123/65 R |
| 3,807,372 | 4/1974 | Garcea | 123/413 |
| 4,114,573 | 9/1978 | Mori | 123/416 |
| 4,492,198 | 1/1985 | Okumura | 123/413 |
| 4,528,953 | 7/1985 | Flaig et al. | 123/413 |
| 4,528,954 | 7/1985 | Slattery | 123/413 |
| 4,566,415 | 1/1986 | Iwai et al. | 123/361 |
| 4,602,602 | 7/1986 | Donohue | 123/413 |
| 4,606,314 | 8/1986 | Yamazaki | 123/413 |
| 4,622,938 | 8/1986 | Wenstadt et al. | 123/413 |
| 4,643,149 | 2/1987 | Dunham et al. | 123/403 |
| 4,747,381 | 5/1988 | Baltz et al. | 123/413 |

FOREIGN PATENT DOCUMENTS

| | | | |
|---|---|---|---|
| 171553 | 8/1934 | Switzerland | 123/413 |

*Primary Examiner*—Andrew M. Dolinar

*Attorney, Agent, or Firm*—Michael, Best & Friedrich

[57] ABSTRACT

Disclosed herein is a marine propulsion device comprising a propulsion unit including a rotatably supported propeller, and an engine drivingly connected to said propeller and comprising an engine block, a spark timing control mechanism rotatably supported by the engine block for spark advancing and retarding movement between a minimum spark advance position and a maximum spark advance position, a throttle supported by the engine block for movement between idle and full speed positions, a control lever supported by the engine block for movement in opposite directions and adapted to be connected to an operator controlled actuating member, and a control linkage connected to the lever and to the throttle and to the spark timing control mechanism, and operative in response to control lever movement, for displacing the throttle from the idle position to a first intermediate position between the idle and the full speed positions without displacing the spark advance position, for displacing the throttle from the first intermediate position to a second intermediate position between the first intermediate position and the full speed position and for simultaneously displacing the spark timing control mechanism to the maximum spark advance position, and for thereafter displacing the throttle from the second intermediate position and toward the full speed position without displacing the spark timing control mechanism from the maximum spark advance position.

25 Claims, 3 Drawing Sheets

MARINE PROPULSION DEVICE WITH SPARK TIMING AND FUEL SUPPLY CONTROL MECHANISM

BACKGROUND OF THE INVENTION

The invention relates generally to marine propulsion devices, such as outboard motors, and to internal combustion engines. In addition, the invention relates to integrated control of the fuel supply and spark timing mechanisms of engines incorporated in outboard motors.

Attention is directed to the following prior art patents:

| | | |
|---|---|---|
| M. Mallory | 1,886,566 | 11/20/29 |
| W. J. Raleigh | 2,635,595 | 05/19/50 |
| E. P. Soder, Jr. | 2,906,251 | 07/25/56 |
| C. F. Alexander | 2,890,689 | 04/22/57 |
| D. T. Doman, et al. | 2,982,275 | 11/14/57 |
| Soder | 2,906,251 | 09/29/59 |
| B. Walker | 3,195,529 | 02/13/63 |
| Akiyama, et al. | 3,734,069 | 05/22/73 |
| Okumura | 4,492,198 | 01/08/85 |
| Flaig, et al. | 4,528,953 | 07/16/85 |
| Slattery | 4,528,954 | 07/16/85 |
| Iwai, et al. | 4,566,415 | 01/28/86 |
| Donohue | 4,602,602 | 07/29/86 |
| Yamazaki | 4,606,314 | 08/19/86 |
| Wenstadt, et al. | 4,622,938 | 11/18/86 |
| Dunham | 4,643,149 | 02/17/87 |

SUMMARY OF THE INVENTION

The invention provides a marine propulsion device comprising a propulsion unit including a rotatably supported propeller, and an engine drivingly connected to the propeller and comprising an engine block, a spark timing mechanism for advancing and retarding the spark between a minimum spark advance and a maximum spark advance, a fuel supply mechanism operable between idle and full speed settings, a control lever supported by the engine block for movement in opposite directions and adapted to be connected to an operator controlled actuating member, and control means connected to the lever and to the fuel supply mechanism and to the spark timing mechanism, and operative in response to control lever movement, for displacing the fuel supply mechanism from the idle setting to a first intermediate setting between the idle setting and the full speed setting without displacing the spark timing mechanism from the minimum spark advance.

In one embodiment of the invention, the control means for the marine propulsion device is also operable, in response to control lever movement, for displacing the fuel supply mechanism from the first intermediate setting to a second intermediate setting between the first intermediate setting and the full speed setting and for simultaneously displacing the spark timing mechanism to the maximum spark advance, and for thereafter displacing the fuel supply mechanism from the second intermediate setting and toward the full speed setting without displacing the spark timing mechanism from the maximum spark advance.

The invention also provides a marine propulsion device comprising a propulsion unit including a rotatably supported propeller, and an engine drivingly connected to the propeller and comprising an engine block, a spark timing control mechanism rotatably supported by the engine block for spark advancing and retarding movement between a minimum spark advance position and a maximum spark advance position, a throttle supported by the engine block for movement between idle and full speed throttle positions, a control lever supported by the block for movement in opposite directions and adapted to be connected to an operator controlled actuating member, throttle control linkage means connected to the lever and to the throttle for displacing the throttle between the idle and full speed positions in response to control lever movement, the throttle control linkage means including a first link, and spark timing control linkage means connected to the first link and to the spark timing control mechanism for retaining the spark timing control mechanism in the minimum spark advance position when the throttle is displaced from the idle position to a first intermediate position between the idle position and the full speed position, for displacing the spark timing control mechanism to the maximum spark advance position when the throttle is displaced from the first intermediate position to a second intermediate position between the first intermediate position and the full speed position, and for thereafter retaining the spark timing control mechanism in the maximum spark advance position when the throttle is displaced from the second intermediate position and toward the full speed position.

The invention also provides an engine comprising an engine block, a spark timing mechanism for advancing and retarding the spark between a minimum spark advance and a maximum spark advance, a fuel supply mechanism operative between idle and full speed settings, a control lever supported by the block for movement in opposite directions and adapted to be connected to an operator controlled actuating member, and control means connected to the lever and to the fuel supply mechanism and to the spark timing control mechanism, and operative in response to control lever movement, for displacing the fuel supply mechanism from the idle setting to a first intermediate setting between the idle setting and the full speed setting without displacing the spark timing mechanism from the minimum spark advance.

In one embodiment in accordance with the invention, the control means for the engine is also operable, in response to control lever movement, for displacing the fuel supply mechanism from the first intermediate setting position to a second intermediate setting between the first intermediate setting and the full speed setting and for simultaneously displacing the spark timing mechanism to the maximum spark advance, and for thereafter displacing the fuel supply mechanism from the second intermediate setting and toward the full speed setting without displacing the spark timing mechanism from the maximum spark advance.

The invention also provides an engine comprising an engine block, a spark timing control mechanism rotatably supported by the engine block for spark advancing and retarding movement between a minimum spark advance position and a maximum spark advance position, a throttle supported by the engine block for movement between idle and full speed throttle positions, a control lever supported by the engine block for movement in opposite directions and adapted to be connected to an operator controlled actuating member, throttle control linkage means connected to the lever and to the throttle for displacing the throttle between the idle and full speed throttle positions in response to control lever movement, the throttle control linkage means including a first link, and spark timing control linkage means connected to the first link and to the spark timing control mechanism for retaining said spark timing control mechanism in the minimum spark advance position when the throttle is displaced from the idle position to a first intermediate position between the idle position and the full speed position, for displacing the spark timing control mechanism to the maximum spark advance position when the throttle is displaced from the first intermediate position to a second intermediate position between the first intermediate position and the full speed position, and for thereafter retaining the spark timing control mechanism in the maximum spark advance position when the throttle is displaced from the second intermediate position and toward the full speed position.

The invention also provides an engine comprising a spark timing mechanism for advancing and retarding the spark between a minimum spark advance and a maximum spark advance, a fuel supply mechanism operative between idle and full speed settings, and control means connected to the fuel supply mechanism and to the spark timing mechanism for displacing the fuel supply mechanism from the idle setting to a first intermediate setting between the idle setting and the full speed setting without displacing the spark timing mechanism from the minimum spark advance.

The invention also provides a fuel supply and spark timing control linkage comprising a tubular link assembly adapted to be connected to a fuel supply mechanism and including a tubular link having an end, an end cap closing the end of the tubular link and having therein a bore with a blind end spaced from the tubular link and an apertured stop spaced from the blind end, a piston located in the end cap between the apertured stop and the blind end of the bore, means in the end cap biasing the piston toward the apertured stop, an elongated link adapted to be connected to a spark timing mechanism, extending through the tubular link and having a end located for projection through the apertured stop for engagement with the piston, and means biasing the elongated link for movement in the direction toward the end cap, which last mentioned means is less forceful than the first mentioned means.

The invention also provides a throttle and spark timing control linkage comprising a tubular link assembly adapted to be connected to an engine throttle and including a tubular link having a first end, a second end, and an interior intermediate shoulder between the first and second ends, a plug closing the first end, an end cap closing the second end and having therein a bore with a blind end spaced from the tubular link and an apertured stop spaced from the blind end, a piston located in the end cap between the apertured stop and the blind end of the bore, a first spring located in the end cap between the piston and the blind end of the bore and biasing the piston toward the apertured stop, an elongated link having a first end adapted to be connected to a spark timing mechanism, a second end, and an enlarged portion between the first and second ends, the elongated link extending through the plug and through the tubular link and being located for projection of the second end through the apertured stop for engagement with the piston, and a second spring surrounding the elongated link within the tubular link and bearing between the plug and the enlarged portion and biasing the elongated link so as to engage the enlarged portion with the shoulder, the second spring having a lesser spring rate than the first spring.

A principal feature of the invention is the provision of control means for displacing the fuel supply mechanism from idle to an intermediate setting without advancing the spark timing. With certain engines, this control means provides improved performance in the low-speed range (e.g., idle to 1000 rpm).

Another principal feature of the invention is the provision of a fuel supply and spark timing linkage as described above. This linkage provides initial throttle opening without spark timing advancement.

Another feature of the invention resides in the fact that the disclosed fuel supply and spark timing linkage is especially suited for a loop charged two stroke internal combustion engine, especially such an engine having a V block.

Other features and advantages of the embodiments of the invention will become known by reference to the following general description, claims and appended drawings.

THE DRAWINGS

Figure 1:
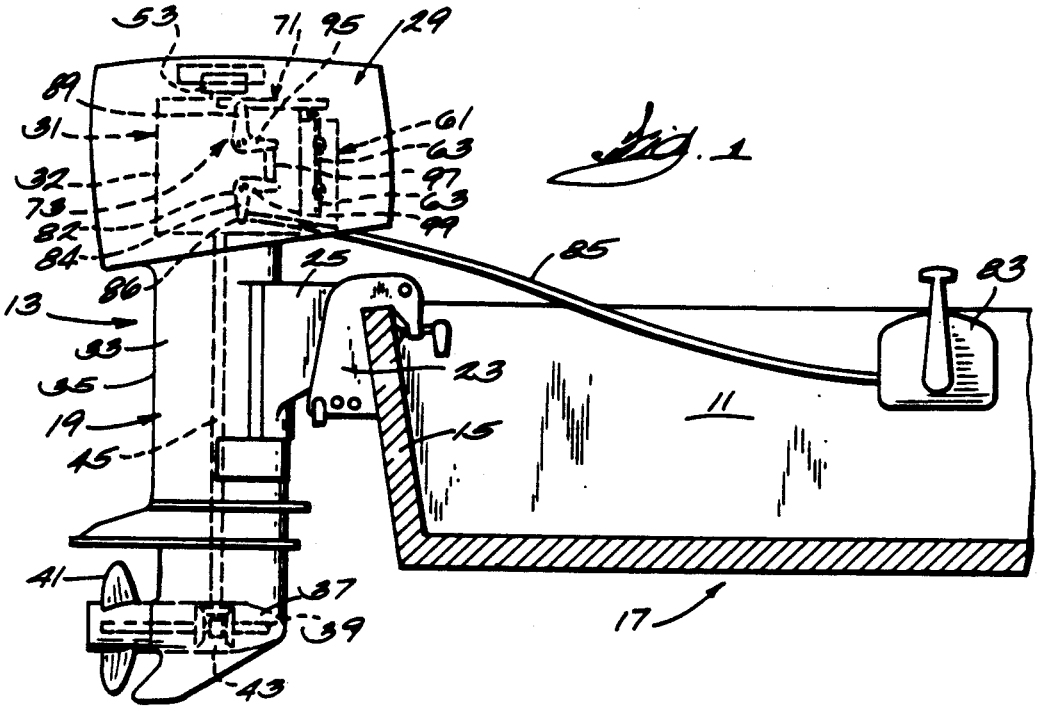
FIG. 1 is a fragmentary view, partially in section, of a marine propulsion installation incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a marine installation 11 comprising a marine propulsion device in the form of an outboard motor 13 which is releasably mounted on the transom 15 of a boat 17.

The outboard motor 13 includes a propulsion unit 19 and means for supporting the propulsion unit 19 from the boat transom 15 for pivotal steering movement about a generally vertical axis and for pivotal tilting movement about a generally horizontal axis. While various arrangements can be employed, in the illustrated construction, such means comprises a transom bracket 23 releasably connected to the transom 15 and a swivel bracket 25 which is connected to the transom bracket 23 about a generally horizontal tilt axis and to the propulsion unit 19 about a steering axis which extends generally vertically under normal operating conditions.

The propulsion unit 19 comprises a power head 29 which includes an internal combustion engine 31 including an engine block 32, and a lower unit 33 which includes a drive shaft housing 35 which, at its upper end, supports the engine 31 and which, at its lower end, is connected to a gear case 37. Rotatably supported within the gear case 37 is a propeller shaft 39 which is fixed to a propeller 41 and which is drivingly connected through a reversing transmission 43 to a drive shaft 45 driven by the engine 31.

Figure 2:
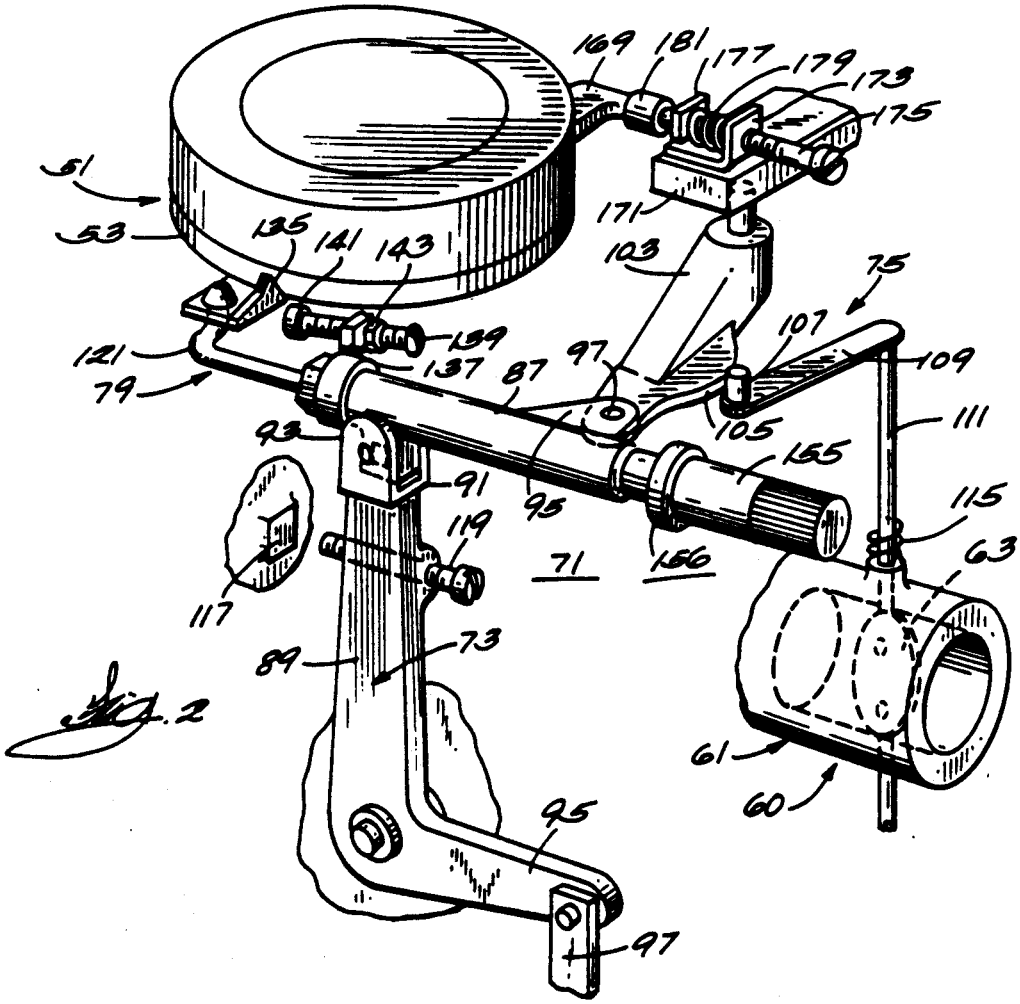
FIG. 2 is a perspective view of an engine control mechanism incorporated in the marine propulsion device shown in FIG. 1.

The engine 31 includes an ignition system (not shown) which is preferably a capacitor discharge system and which includes one or more trigger coils (not shown) carried by a spark timing control mechanism 51 including a timer base 53. The timer base 53 is rotatably supported by the engine block 32 for rotary movement in opposite rotary directions between a first or minimum spark advance position in which the spark advance is at a minimum (or is actually retarded) and a second o maximum spark advance position in which the spark advance is at a maximum. As shown in FIG. 2, spark advance occurs in response to counter-clockwise timer base rotation and spark retard occurs in response to clockwise rotation of the timer base 53. Other spark timing mechanisms, including electronic mechanisms, can be employed.

The engine 31 also includes a fuel supply mechanism 60. While various fuel supply mechanisms can be employed, including air-swept and other types of fuel injection, in the illustrated construction, the fuel supply mechanism comprises one or more carburetors 61 which are supported by the engine block 32 and which include respective throttles or valve plates 63 which are movable between an idle or closed throttle setting or position and a full speed or wide-open throttle position or setting.

The spark timing control mechanism 51 and the fuel supply mechanism 60 are controlled by the operator through a control means or mechanism 71 which can take various forms and which, in the illustrated construction, includes a control lever 73 supported on the engine block 32 for pivotal movement, a throttle linkage 75 connecting the control lever 73 to the fuel supply mechanism 60, a spark timing linkage 79 connecting the control lever 73 to the spark timing control mechanism 51, and a remotely located single lever control 83 which is mounted on the boat 17, which is connected to the control lever 73 by a push-pull cable 85 to cause control lever movement in response to operation of the single lever control 83, and which constitutes an operator controlled actuating member. In turn, movement of the control lever 73 causes integrated operation of the spark timing control mechanism 51 and the fuel supply mechanism 60.

More particularly, the control lever 73 comprises a bell crank lever including an upright arm 89 which, at the lower end thereof, is pivoted on the engine block 32 and which includes, at its upper end, a clevis 91 including a pair of spaced ears 93. The bell crank lever also includes a horizontally extending arm 95 which is pivotally connected to a vertically oriented link 97 which, in turn, is connected to the horizontal arm 99 of a second bell crank lever 82 which is suitably pivotally mounted on the engine block 32 and which includes a downwardly extending arm 84 having an outer end 86 which is connected to the end of the push-pull cable 85. At its opposite end, the push-pull cable 85 is connected to the single lever control 83. Other arrangements can also be employed for pivoting the control lever 73.

While various other constructions can be employed, in the illustrated construction, the throttle controlling linkage 75 connects the control lever 73 to the throttle 63 and includes a first link which can take various forms and which, in the illustrated construction, comprises an elongated throttle housing or tubular throttle link 87 which functions as a rigid link between the control lever 73 and a throttle control arm 103 to be described, and which also serves as a housing for a spark timing link 121 to be described. The throttle link 87 is provided, at one end, (see FIGS. 3 through 6) with a box like opening 88 which is received within the clevis 91 and which, in turn, receives a pivot pin 90. The pivot pin 90 extends between the clevis ears 93 and through the opening 88 to provide for relative pivotal movement between the tubular throttle link 87 and the control lever 73, and for limited relative movement radially with respect to the control lever pivot and between the control lever 73 and the tubular throttle link 87.

The throttle link 87 also includes, adjacent the other end thereof, a tab 95 having a stud 97 which is received in an aperture 101 in the outer end of a throttle control arm 103 pivotally supported by the engine block 32. Other arrangements can be employed for pivotally connecting the tab 95 and the throttle control arm 103. As a consequence, movement of the tubular throttle link 87 in the general direction of the length thereof causes rotary movement of the throttle control arm 103.

Provided on the throttle control ar 103 is (see FIG. 2) a cam surface 105 which is engaged by a follower 107 extending from the end of a lever 109 fixed to a shaft 111 carrying the throttle or valve plate 63. Thus, rotation of the throttle control arm 103 causes rotation of the throttle 63 between its idle and full speed positions. The rate of opening and closing of the throttle or valve plate 63 in relation to movement of the control lever 73 can be varied by modification of the contour of the cam surface 105.

The throttle 63 is biased toward the idle or closed position by a spring 115 which is operatively mounted on the shaft 111 and which also serves to bias the follower 107 into engagement with the cam surface 105.

Means are also provided for limiting movement of the control lever 73 in the throttle closing or counter-clockwise direction, as shown in FIG. 2, so as to prevent such control lever movement as would disengage the cam surface 105 from the follower 107 when the throttle 63 is releasably retained in the idle or closed position by the spring 115. While various arrangements can be employed, in the illustrated construction, such means comprises a stop surface 117 on the engine block 32 and an adjustable stop screw 119 threadedly extending through the control lever 73 for engagement with the stop surface 117 to limit counterclockwise movement, of the control lever 73. If desired, a lock nut (not shown) can be employed to releasably fix the stop screw 119 in adjusted position. In addition, if desired, the throttle 63 can be provided with one or more apertures (not shown) for affording passage through the throttle 63 of combustion air for idle operation.

The control mechanism 71 for controlling both spark timing and throttle setting also includes the before mentioned spark timing linkage 79 connecting the control lever 73 to the timer base 53. While other arrangements can be employed, in the illustrated construction, the spark timing linkage 79 comprises the tubular throttle link 87, together with an elongated spark control rod or spark timing link or member 121 which is suitably connected to the timer base 53 to effect movement thereof in response to lengthwise movement of the spark timing link 121 and which extends into the tubular throttle link 87.

Means are also provided for connection between the throttle link 87 and the spark timing link 121 to afford, in response to control lever movement, common movement of both links 87 and 121, as well as relative movement therebetween. While other arrangements can be employed, in the illustrated construction, such means comprises (see FIGS. 3-6) a helical spring 125 which is located within the tubular throttle link 87 and in surrounding relation to the spark timing link 121 and which bears, at the end adjacent the timer base 53, against a plug 127 threaded into the throttle link 87 and, at the other end, against an enlarged spark timing link portion in the form of a snap ring 129 fixed on the spark timing link 121. As a consequence, the spark timing link 121 is urged to the right, relative to the tubular throttle link 87, toward a position wherein the snap ring 129 engages a shoulder 131 within the tubular throttle link 87. Accordingly, in the absence of restraint against movement of the spark timing link 121, the tubular throttle link 87 and the spark timing link 121 have common movement.

Rotation of the timer base 53 in the spark advancing direction from the minimum spark advance position to the maximum spark advance position is limited, and the maximum spark advance position is defined by suitable stop means. While other arrangements can be employed, in the illustrated construction, such advanced spark stop means comprises interengaging means on the timer base 53 and on the engine block 32. Preferably, such means is adjustable and slightly resilient. Thus, as shown in FIG. 2, the timer base 53 includes a tab or projection 135 and the engine block 32 has thereon a boss 137 in which an abutment member or stop screw 139 is adjustably threaded and located for engagement with the projection 135 to limit spark advancing movement of the timer base 53 and establish the maximum spark advance position. Preferably, the end of the stop screw 139 has thereon a rubber button 141 which provides some degree of resilience. In addition, a suitable locking nut 143 can be employed to prevent unwanted movement of the stop screw 139 in the boss 137 so as to retain a preset position.

Such restriction in rotary movement of the timer base 53 restrains movement of the spark timing link 121 with the tubular throttle link 87 and thus, when the control lever 73 is moved in the throttle advancing direction, as thus far described, the tubular throttle link 87 and the spark timing link 121 are initially moved in unison to advance the spark timing and to increasingly open the throttle 63. However, when the timer base 53 reaches the maximum spark advance position, the spark timing link 121 is restrained from further movement and continued movement of the control lever 73 to fully open the throttle 63 serves to effect continued movement of the tubular throttle link 87 to the right in FIG. 2 and relative to the spark timing link 121 and against the action of the spring 125 to cause increased opening of the throttle 63 without advancing the spark timing.

As thusfar disclosed, the illustrated construction is conventional and has been in public use for more than one year prior to filing of this application.

The control mechanism 71 also includes means for permitting initial opening of the throttle 63 without advancing the spark timing from the minimum spark advance position, which means also preferably includes means for adjustably determining the amount of the initial opening of the throttle 63 prior to commencement of spark advancing movement.

While various arrangements can be employed, in the illustrated construction, such means comprises means operative, in response to the initial advance of the control lever 73 to open the throttle 63 from the idle position, to facilitate throttle opening movement of the tubular throttle link 87 and concurrent relative movement between the throttle link 87 and the spark timing link 121 such that the timer base 53 remains stationary. While various other arrangements can be employed, in the illustrated construction, such means comprises means for pre-loading the spark timing link 121 for movement relative to the throttle link 87 outwardly to the left in FIG. 2. Such pre-loading is provided by a helical dwell spring 151 which is stronger than the spring 125, i.e., has a greater spring rate, which is located in a blind bore 153 in a tubular end cap or member 155 which is suitably fixed on the tubular throttle link 87 at the end remote from the timer base 53. Peferably, the end cap 155 is threaded or screwed onto the throttle link 87, and a locking nut or thumb wheel 156 is provided to releasably retain the end cap 155 in axially adjusted position relative to the throttle link 87, and thereby to vary the amount of throttle opening which will occur prior to commencement of spark advance. The outer surface of the end cap 155 can be textured to facilitate such adjustment.

At one end, the spring 151 bears against the blind end of the bore 153 and, at the other end, the spring 151 bears against a piston 157 which is movable within the tubular end cap 155 and outwardly of the end cap 155 under the action of the spring 151 and relative to an apertured stop 159 fixed in the tubular end cap 155. The piston 157 is adapted to be engaged by the right end 161 of the spark timing link 121, which end 161 is located for projection through the central aperture in the stop 159 so that, when the control lever 73 is in the position with the throttle 63 in the idle or closed position, the right end 161 bears against the piston 157 and compresses the spring 151 to produce the desired pre-load in the spring 151.

In order to prevent the spring 151 from acting to relieve the stress therein by rotating the timer base 53 in the spark retarding direction beyond the desired minimum spark advance position, stop means are provided for limiting movement of the timer base 53 in the spark retarding direction to establish the minimum spark advance position. Preferably such stop means is adjustable and slightly resilient. While other constructions can be employed, in the illustrated construction, such idle spark stop means comprises, as shown in FIG. 2, a projection 169 extending from the timer base 53 for abutment with a suitable stop on the engine block 32. More particularly, and while other arrangements can be employed, in the illustrated construction, the engine block 32 includes a bracket 171 which has thereon an upstanding ear 173 through which is threaded a stop member or screw 175. The screw 175 also threadedly engages a nut 177 which bears against the bracket 171 to prevent stop screw rotation. In order to minimize unwanted movement of the stop screw 175 relative to the bracket 171, a coil spring 179 is located around the stop screw 175 and between the ear 173 and the nut 177 to increase the force required to cause threaded movement of the stop screw 175 and consequent axial movement of the stop screw 175 relative to the bracket 171. Preferably, the outer end of the stop screw 175 is provided with a rubber button 181 to provide limited resiliency during stopping action.

Figure 7:
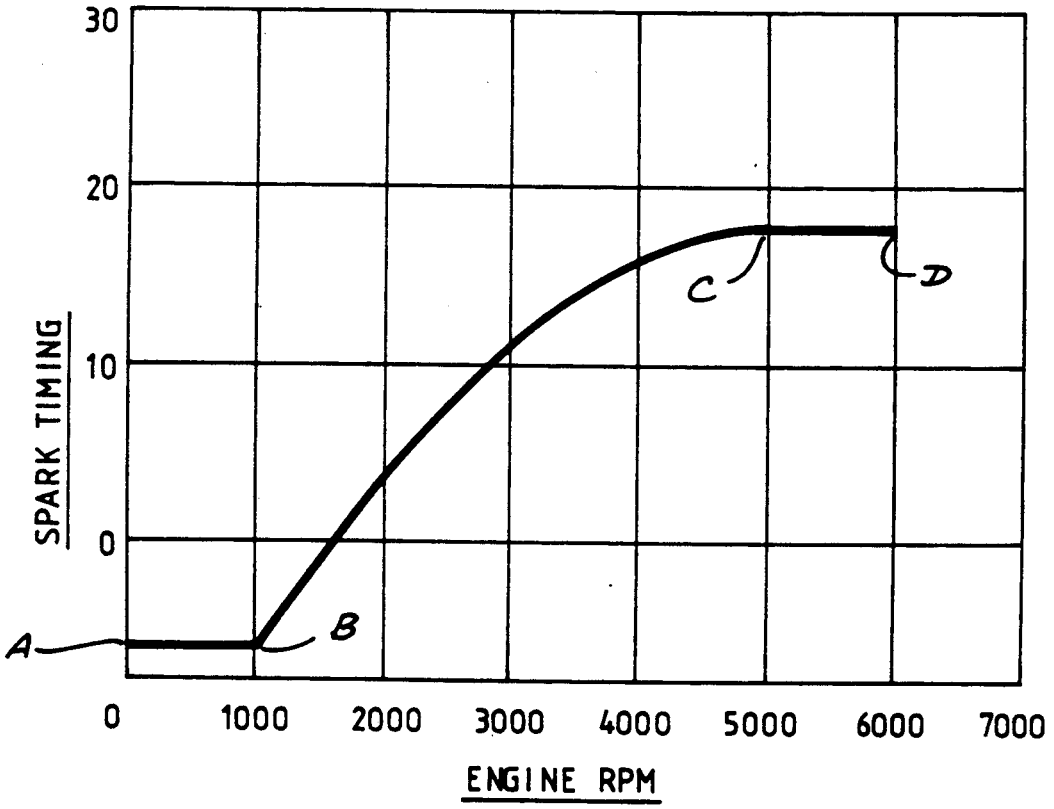
FIG. 7 is a plot of the relation between spark timing and engine rpm effected by the mechanism shown in FIG. 2.

The operation of the mechanism 71 for controlling both spark timing and throttle setting is shown in FIGS. 3 through 6. In addition, FIG. 7 discloses a plot 201 of spark timing verses engine rpm resulting from the disclosed construction.

Figures 3, 4, 5, 6:
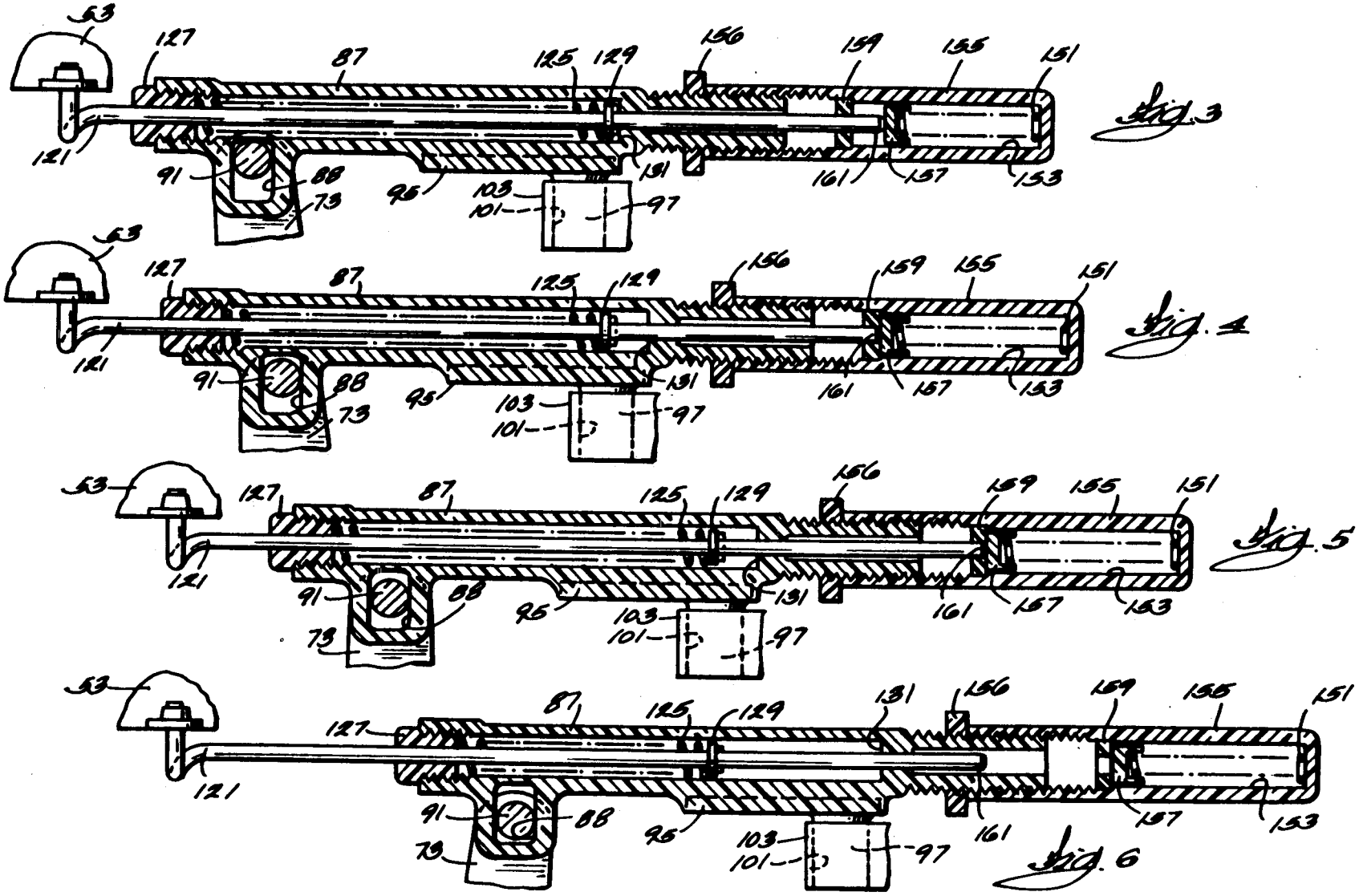
FIGS. 3 through 6 are enlarged, fragmentary, and partially sectioned views of the mechanism shown in FIG. 2, with components located in different positions.

In FIG. 3, the components are shown in the position wherein the control lever 73 positions the throttle link 87 so as to locate the throttle 63 in the closed or idle position. Such position of the throttle link 87 causes the spark timing link 121 to engage the piston 157 and to displace the piston 157 to the right, away from the shoulder or stop 159 so as to compress the spring 151. It is noted that the stop screw 175 prevents movement of the timer base 53 in the spark retarding direction beyond the minimum spark advance position, thereby preventing the spring 151 from displacing the spark timing link 121 toward the left, and thereby pre-loading the spring 151. The location of the components shown in FIG. 3 corresponds to the point "A" in the plot 201 shown in FIG. 7.

When the throttle link 87 is initially displaced to the right by clockwise movement of the control lever 73 so as to initiate throttle opening movement, the throttle link 87 begins to move to the right to open the throttle 63 and the pre-load in the spring 151 is increasingly diminished, with the result that the spark timing link 121 moves relatively to the left or projects outwardly relative to the throttle link 87 by action of the spring 151, while the timer base 53 remains in the minimum advance position.

When the control lever 73 has been sufficiently moved in the opening direction, the piston 157 engages the stop or shoulder 159, thereby discontinuing movement of the spark timing link 121 to the left relative to the throttle link 87 and locating the components as shown in FIG. 4. The location of the components shown in FIG. 4 corresponds to the point "B" on the plot 201 shown in FIG. 7.

Continued movement of the control lever 73 to open the throttle 63 causes continued movement of the throttle link 87 to the right accompanied by corresponding movement of the spark timing link 121, thereby concurrently advancing the spark timing and causing continuing opening of the throttle 63. Common movement of the spark timing link 121 and the throttle link 87 continues until the timer base 53 engages the stop screw 139 defining the maximum spark advance position. The relative location of the components at this point is shown in FIG. 5 and corresponds to the point "C" on the plot 201 shown in FIG. 7.

Still further clockwise movement of the control lever 73 causes continued movement of the throttle link 87 to the right. However, as the timer base 53 is restrained from further movement in the spark advancing position by the stop screw 139, the spark timing link 121 and the throttle link 87 now experience movement relative to each other as the throttle 63 moves to the open or full speed position and the timer base 53 remains in the maximum spark advance position. The location of the components when the throttle is in the full speed position is shown in FIG. 6 and corresponds to the position "D" on the plot 201 shown in FIG. 7.

When the control lever 73 is activated to initiate closure of the throttle 63 from the full speed or open position, the tubular throttle link 87 is initially moved to the left and the spring 125 causes the spark timing link 121 to retract into the tubular throttle link 87, while the timer base 53 remains in the maximum spark advance position. When the end 161 of the link 121 engages the piston 157, the spring 151 prevents further retraction of the link 121 into the throttle link 87, and continued movement of the control lever 73 to cause closing of the throttle 63 causes leftward movement of the throttle link 87 accompanied by common movement of the spark advancing link 121 to cause concurrent increasing closure of the throttle 63 and movement of the timer base 53 in the spark retarding direction.

Continued throttle closing movement of the control lever 73 causes the timer base 53 to engage the stop screw 175 to prevent further movement in the spark retarding direction. Thereafter, continued movement of the control lever 73, in the direction causing throttle closure, causes retraction of the spark timing link 121 into the tubular throttle link 87 with the right end 161 of the spark timing link 121 causing displacement of the piston 157 to the right and consequent tensioning of the spring 151.

Thus as a result of the disclosed construction, the control mechanism 71 causes, during throttle opening movement, initial retention of the timer base 53 in the minimum spark advance position, followed by concurrent advancement of the spark timing with continued opening of the throttle 63, followed by retention of the timer base 53 in the maximum spark advance position while the throttle 63 is moved to the open or full speed position A reverse sequence takes place during throttle closing movement of the control lever 73.

The threaded connection of the end cap 155 on the tubular throttle link 87 facilitates adjustment of the duration of the interval during which the timer base 53 remains in the minimum spark advance position at the initiation of control lever movement opening the throttle 63, whereby to facilitate attainment of maximum desirable engine performance characteristics. The further the cap 155 is screwed onto the link 87, the more the spring 151 is tensioned when the throttle 63 is closed, and the more the throttle 63 is opened before spark advancement begins.

Various of the features of the invention are set forth in the following claims.

We claim:

1. A marine propulsion device comprising a propulsion unit including a rotatably supported propeller, and an engine drivingly connected to said propeller and comprising an engine block, a spark timing mechanism for advancing and retarding the spark between a minimum spark advance and a maximum spark advance, a fuel supply mechanism operable between idle and full speed settings, a control lever supported by said engine block for movement in opposite directions and adapted to be connected to an operator controlled actuating member, and control means connected to said lever and to said fuel supply mechanism and to said spark timing mechanism, and operative in response to control lever movement, for displacing said fuel supply mechanism from said idle setting to a first intermediate setting between said idle setting and said full speed setting without displacing said spark timing mechanism from said minimum spark advance.

2. A marine propulsion device in accordance with claim 1 wherein said control means is also operable, in response to control lever movement, for displacing said fuel supply mechanism from said first intermediate setting to a second intermediate setting between said first intermediate setting and said full speed setting and for simultaneously displacing said spark timing mechanism to said maximum spark advance, and for thereafter displacing said fuel supply mechanism from said second intermediate setting and toward s id full speed setting without displacing said spark timing mechanism from said maximum spark advance.

3. A marine propulsion device comprising a propulsion unit including a rotatably supported propeller, and an engine drivingly connected to said propeller and comprising an engine block, a spark timing control mechanism rotatably supported by said engine block for spark advancing and retarding movement between a minimum spark advance position and a maximum spark advance position, a throttle supported by said engine block for movement between idle and full speed throttle positions, a control lever supported by said block for movement in opposite directions and adapted to be connected to an operator controlled actuating member, throttle control linkage means connected to said lever and to said throttle for displacing said throttle between said idle and full speed positions in response to control lever movement, said throttle control linkage means including a first link, and spark timing control linkage means connected to said first link and to said spark timing control mechanism for retaining said spark timing control mechanism in said minimum spark advance position when the throttle is displaced from said idle position to a first intermediate position between said idle position and said full speed position, for displacing said spark timing control mechanism to said maximum spark advance position when said throttle is displaced from said first intermediate position to a second intermediate position between said first intermediate position and said full speed position, and for thereafter retaining said spark timing control mechanism in said maximum spark advance position when said throttle is displaced from said second intermediate position and toward said full speed position.

4. A marine propulsion device in accordance with claim 3 and further including means for limiting rotary displacement of said spark timing control mechanism in the direction toward said minimum spark advance position.

5. A marine propulsion device in accordance with claim 4 and further including means for limiting rotary displacement of said spark timing control mechanism in the direction toward said maximum spark advance position.

6. A marine propulsion device in accordance with claim 3 wherein said spark timing control linkage includes a second link connected to said spark timing control mechanism, first means operably connecting said first and second links and biasing said links for retraction of said second link in one direction relative to said first link, and second means releasably and operably connecting said links and biasing said links for projection of said second link relative to said first link in the direction opposite said one direction through a predetermined distance, said second biasing means being stronger than said first biasing means.

7. A marine propulsion device in accordance with claim 6 wherein said first connecting means comprising a spring, and wherein said second connecting means comprises a spring, said second spring being compressed through a given distance in response to control lever movement causing displacement of said throttle to said idle position.

8. A marine propulsion device in accordance with claim 7 and further including means for adjusting the length of said given distance.

9. A marine propulsion device in accordance with claim 3 wherein said first link comprises a tubular link having an end, and wherein said spark timing linkage control means includes an end cap closing said end of said tubular link and having therein a bore with a blind end spaced from said tubular link and an apertured stop spaced from said blind end, a piston located in said end cap between said apertured stop and said blind end of said bore, means in said end cap biasing said piston toward said apertured stop, an elongated link adapted to be connected to said spark timing control mechanism, extending through said tubular link and having an end located for projection through said apertured stop for engagement with said piston, and means biasing said elongated link for movement in the direction toward said end cap, said last mentioned means being less forceful than said first mentioned means.

10. A marine propulsion device in accordance with claim 3 wherein said first link comprises a tubular link having a first end, and a second end, and wherein said spark linkage control means includes an interior intermediate shoulder in said tubular link between said first and second ends, a plug closing said first end, an end cap closing said second end, said end cap having therein a bore with a blind end spaced from said tubular link and an apertured stop spaced from said blind end, a piston located in said end cap between said apertured stop and said blind end of said bore, a first spring located in said end cap between said piston and said blind end of said bore and biasing said piston toward said apertured stop, and an elongated link having a first end adapted to be connected to a spark timing mechanism, a second end, and an enlarged portion between said first and second ends, said elongated link extending through said plug and through said tubular link and being located for projection of said second end through said apertured stop for engagement with said piston, and a second spring surrounding said elongated link within said tubular link and bearing between said plug and said enlarged portion and biasing said elongated link so as to engage said enlarged portion with said shoulder, said second spring having a lesser spring rate than said first spring.

11. An engine comprising an engine block, a spark timing mechanism for advancing and retarding the spark between a minimum spark advance and a maximum spark advance, a fuel supply mechanism operative between idle and full speed settings, a control lever supported by said block for movement in opposite directions and adapted to be connected to an operator controlled actuating member, and control means connected to said lever and to said fuel supply mechanism and to said spark timing mechanism, and operative in response to control lever movement for displacing said fuel supply mechanism from said idle setting to a first intermediate setting between said idle setting and said full speed setting without displacing said spark timing mechanism from said minimum spark advance 12. An engine in accordance with claim 11 wherein said control means is also operable, in response to control lever movement, for displacing said fuel supply mechanism from said first intermediate setting to a second intermediate setting between said first intermediate setting and said full speed setting and for simultaneously displacing said spark timing mechanism to said maximum spark advance, and for thereafter displacing said fuel supply mechanism from said second intermediate setting and toward said full speed setting without displacing said spark timing mechanism from said maximum spark advance.

13. An engine comprising an engine block, a spark timing control mechanism rotatably supported by said engine block for spark advancing and retarding movement between a minimum spark advance position and a maximum spark advance position, a throttle supported by said engine block for movement between idle and full speed throttle positions, a control lever supported by said block for movement in opposite directions and adapted to be connected to an operator controlled actuating member, throttle control linkage means connected to said lever and to said throttle for displacing said throttle between said idle and full speed positions in response to control lever movement, said throttle control linkage means including a first link, and spark timing control linkage means connected to said first link and to said spark timing control mechanism for retaining said spark timing control mechanism in said minimum spark advance position when said throttle is displaced from said idle position to a first intermediate position between said idle position and said full speed position, for displacing said spark timing control mechanism to said maximum spark advance position when said throttle is displaced from said first intermediate position to a second intermediate position between said first intermediate position and said full speed position, and for thereafter retaining said spark timing control mechanism in said maximum spark advance position when said throttle is displaced from said second intermediate position and toward said full speed position.

14. An engine in accordance with claim 13 and further including means for limiting rotary displacement of said spark timing control mechanism in the direction toward said minimum spark advance position.

15. An engine in accordance with claim 14 and further including means for limiting rotary displacement of said spark timing control mechanism in the direction toward said maximum spark advance position.

16. An engine in accordance with claim 13 wherein said spark timing control linkage includes a second link connected to said spark timing control mechanism, first means operably connected said first and second links and biasing said links for retraction of said second link in one direction relative to said first link, and second means releasably and operably connecting said links and biasing said links for projection of said second link relative to said first link in the direction opposite said one direction through a predetermined distance, said second biasing means being stronger than said first biasing means.

17. An engine in accordance with claim 16 wherein said first connecting means comprises a spring, and wherein said second connecting means comprises a spring, said second spring being compressed through a given distance in response to control lever movement causing displacement of said throttle to said idle position.

18. An engine in accordance with claim 17 and further including means for adjusting the length of said given distance.

19. An engine in accordance with claim 13 wherein said first link comprises a tubular link having an end, and wherein said spark timing linkage control means includes an end cap closing said end of said tubular link and having therein a bore with a blind end spaced from said tubular link and an apertured stop spaced from said blind end, a piston located in said end cap between said apertured stop and said blind end of said bore, means in said end cap biasing said piston toward said apertured stop, an elongated link adapted to be connected to said spark timing control mechanism, extending through said tubular link and having an end located for projection through said apertured stop for engagement with said piston, and means biasing said elongated link for movement in the direction toward said end cap, said last mentioned means being less forceful than said first mentioned means.

20. An engine in accordance with claim 13 wherein said first link comprises a tubular link having a first end, and a second end, and wherein said spark linkage control means includes an interior intermediate shoulder in said tubular link between said first and second ends, a plug closing said first end, an end cap closing said second end, said end cap having therein a bore with a blind end spaced from said tubular link and an apertured stop spaced from said blind end, a piston located in said end cap between said apertured stop and said blind end of said bore, a first spring located in said end cap between said piston and said blind end of said bore and biasing said piston toward said apertured stop, and an elongated link having a first end adapted to be connected to a spark timing mechanism, a second end, and an enlarged portion between said first and second ends, said elongated link extending through said plug and through said tubular link and being located for projection of said second end through said apertured stop for engagement with said piston, and a second spring surrounding said elongated link within said tubular link and bearing between said plug and said enlarged portion and biasing said elongated link so as to engage said enlarged portion with said shoulder, said second spring having a lesser spring rate than said first spring.

21. An engine comprising a spark timing mechanism for advancing and retarding the spark between a minimum spark advance and a maximum spark advance, a fuel supply mechanism operative between idle and full speed settings, and control means connected to said fuel supply mechanism and to said spark timing mechanism for displacing said fuel supply mechanism from the idle setting to a first intermediate setting between the idle setting and the full speed setting without displacing said spark timing mechanism from said minimum spark advance.

22. A fuel supply and spark timing control linkage comprising a tubular link assembly adapted to be connected to a fuel supply mechanism and including a tubular link having an end, an end cap closing said end of said tubular link and having therein a bore with a blind end spaced from said tubular link and an apertured stop spaced from said blind end, a piston located in said end cap between said apertured stop and said blind end of said bore, means in said end cap biasing said piston toward said apertured stop, an elongated link adapted to be connected to a spark timing mechanism, extending through said tubular link and having an end located for projection through said apertured stop for engagement with said piston, and means biasing said elongated link for movement in the direction toward said end cap, said last mentioned means being less forceful than said first mentioned means 23. A throttle and spark timing control linkage comprising a tubular link assembly adapted to be connected to an engine throttle and including a tubular link having a first end, a second end, and an interior intermediate shoulder between said first and second ends, a plug closing said first end, an end cap closing said second end, said end cap having therein a bore with a blind end spaced from said tubular link and an apertured stop spaced from said blind end, a piston located in said end cap between said apertured stop and said blind end of said bore, a first spring located in said end cap between said piston and said blind end of said bore and biasing said piston toward said apertured stop, and an elongated link having a first end adapted to be connected to a spark timing mechanism, a second end, and an enlarged portion between said first and second ends, said elongated link extending through said plug and through said tubular link and being located for projection of said second end through said apertured stop for engagement with said piston, and a second spring surrounding said elongated link within said tubular link and bearing between said plug and said enlarged portion and biasing said elongated link so as to engage said enlarged portion with said shoulder, said second spring having a lesser spring rate than said first spring.

24. An engine comprising a spark timing mechanism for advancing and retarding the spark between a minimum spark advance and a maximum spark advance, a fuel supply mechanism operative between idle and full speed settings, and control means connected to said fuel supply mechanism and to said spark timing mechanism for displacing said fuel supply mechanism from the idle setting to a first intermediate setting between the idle setting and the full speed setting without displacing said spark timing mechanism from said minimum spark advance, for displacing said spark timing control mechanism to said maximum spark advance position when said fuel supply mechanism is displaced from said first intermediate position to a second intermediate position between said first intermediate position and said full speed position, and for thereafter retaining said spark timing control mechanism in said maximum spark advance position when said fuel supply mechanism is displaced from said second intermediate position and toward said full speed position.

25. An engine comprising an engine block, a spark timing control mechanism supported by said engine block for spark advancing and retarding movement between a minimum spark advance position and a maximum spark advance position, a throttle supporting by said engine block for movement between idle and full speed throttle positions, a control lever supported by said block for movement in opposite directions and adapted to be connected to an operator controlled actuating member, a throttle control linkage connected to said lever and to said throttle for displacing said throttle between said idle and full speed positions in response to control lever movement, and a spark timing control linkage connected to said lever and to said spark timing control mechanism for retaining said spark timing control mechanism in said minimum spark advance position when said throttle is displaced from said idle position to a first intermediate position between said idle position and said full speed position, for displacing said spark timing control mechanism to said maximum spark advance position when said throttle is displaced from said first intermediate position to a second intermediate position between said first intermediate position and said full speed position, and for thereafter retaining said spark timing control mechanism in said maximum spark advance position when said throttle is displaced from said second intermediate position and toward said full speed position.

* * * * *